United States Patent [19]

Eppe et al.

[11] 4,146,822

[45] Mar. 27, 1979

[54] ELECTROPHOTOGRAPHIC COPIER

[75] Inventors: Rudolf Eppe, Taufkirchen; Josef Pfeifer, Unterhaching, both of Fed. Rep. of Germany

[73] Assignee: AGFA-Gevaert Ag, Leverkusen, Fed. Rep. of Germany

[21] Appl. No.: 817,107

[22] Filed: Jul. 19, 1977

[30] Foreign Application Priority Data

Jul. 22, 1976 [DE] Fed. Rep. of Germany ..... 2633019

[51] Int. Cl.[2] ..... H05B 41/30

[52] U.S. Cl. ..... 315/241 R; 315/303; 320/1; 355/69

[58] Field of Search ..... 315/241 R, 303; 320/1; 355/69

[56] References Cited

U.S. PATENT DOCUMENTS 2,632,133 3/1953 McNulty ..... 315/241 R X 2,922,078 1/1960 Maillet ..... 315/241 R X 2,952,798 9/1960 Ferris et al. ..... 315/241 R X

*Primary Examiner*—Eugene R. LaRoche

*Attorney, Agent, or Firm*—Michael J. Striker

[57] ABSTRACT

In an electrophotographic copier a fusing station is provided at which a toner image previously formed on a copy carrier is fixed on the carrier by fusing. The fusing station includes a flash tube which, when discharged, produces the heat required for the fusing operation. The electrical energy required by the flash tube is supplied from a flash capacitor. To avoid current spikes during charging of the flash capacitor the same receives its current from a drive system which includes a motor-driven generator in circuit with the flash tube; the inertia of the drive system acts as a buffer between the flash capacitor and the current supply source and prevents the occurrence of current peaks during the charging of the capacitor.

6 Claims, 1 Drawing Figure

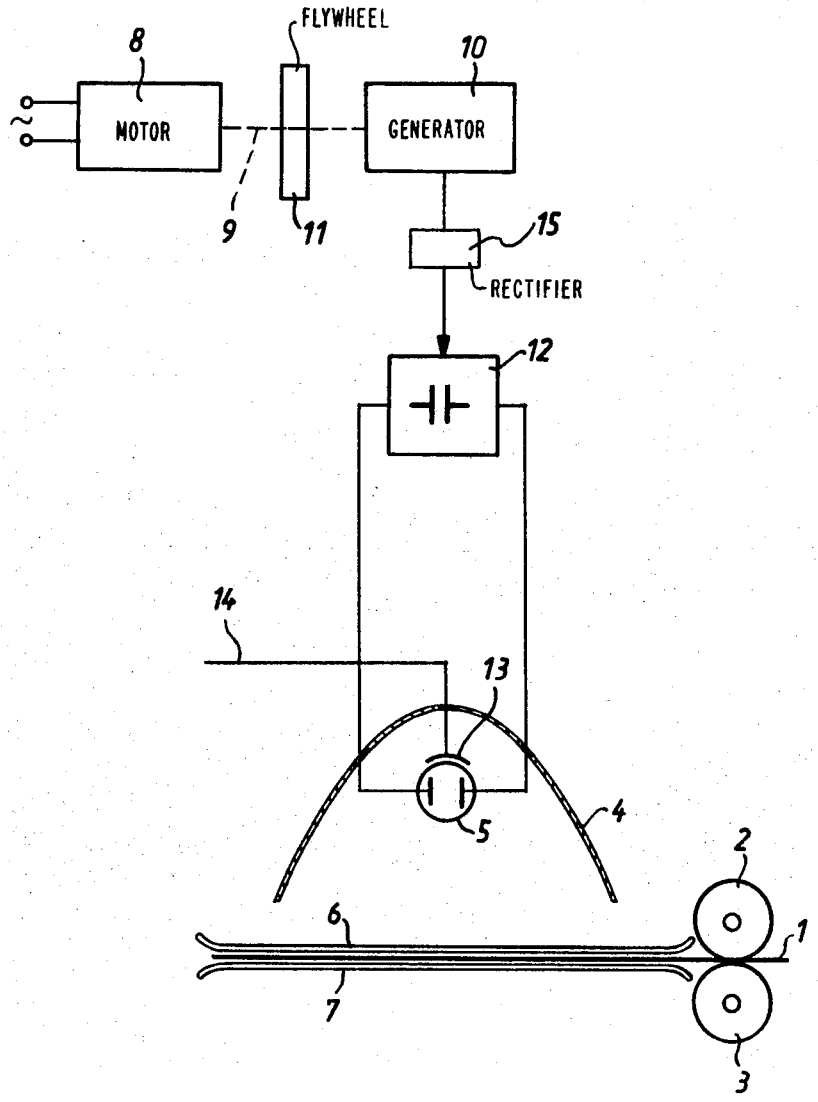
FLYWHEEL
8
10
MOTOR
GENERATOR
9
11
15
RECTIFIER
12
14
13
5
4
2
6
1
7
3

ELECTROPHOTOGRAPHIC COPIER

BACKGROUND OF THE INVENTION

1. Field of the Invention

The invention relates to an arrangement for preventing the occurrence of current spikes during the charging of a capacitor.

More particularly, the invention relates to an electrophotographic copier in which the occurrence of current spikes is to be prevented during the charging of a flash capacitor which supplies the flash tube of a fusing station.

2. The Prior Art

Electrophotographic copiers are well known and require no detailed description for that reason. Briefly stated, the principle of operation of such apparatus is that an image carrier (plate, belt, drum) having a photoconductive surface is given a uniform electric charge over this surface and is thereupon exposed to the subject matter to be reproduced. This discharges the areas of the photoconductive surface in accordance with the radiation intensity which reaches them during the exposure, thereby creating on the surface a latent electrostatic image of the original being copied.

This image is then developed by bringing a toner powder into contact with the photoconductive surface, to which the toner powder clings electrostatically in a pattern corresponding to the electrostatic image. The thus developed image is then transferred to a support or copy carrier, e.g., a copy sheet. However, after such transfer the image must be fixed on the copy carrier, since otherwise it would simply rub off the same. This fixing is usually effected in a fusing station where the toner particles making up the image are heated so that they soften and coalesce, becoming sticky and firmly adhering to the copy carrier.

When heat fusing is employed, the heat can be supplied in various ways. The older approach was to use electrically heated resistance elements (e.g., U.S. Pat. No. 2,965,868 to Eichler); however, in higher-speed copiers (i.e., copiers capable of making large numbers of copies per unit time) the requisite heat is now often supplied by flash tubes. These are gas-discharge tubes which produce a high-intensity, short-duration flash of light, and in so doing, liberate the requisite heat energy. The high energy required for producing the flash in supplied from a flash capacitor which must, of course, have a correspondingly high energy storage capability. Since these arrangements are used in high-speed copiers, it is important that after each discharge the capacitor is rapidly recharged. This is where problems occur.

In the prior art the flash capacitor is connected to the current-supply net. When the flash capacitor begins to recharge (after a previous discharge), strong current spikes or peaks occur which tend to overload the supply net. Since this is undesirable it has been proposed to use a phase angle control circuit which reduces the draw of charging current to the flash capacitor, to dampen out the peaks.

However, when a high flash frequency is required (in keeping with the making of a great number of copies per unit time), a phase angle control circuit cannot be satisfactorily used in conjunction with a low-ohmic current supply net. The reason is that the time available for each individual charge episode of the flash capacitor is not well used in these circumstances, so that excessively high current peaks develop during the effort to charge the capacitor within the available time to the high energy level which is required to cause sufficient heat emission from the flash tube for fusing of the toner.

SUMMARY OF THE INVENTION

It is an object of the invention to overcome the disadvantages of the prior art.

More particularly, it is an object of the invention to provide an arrangement of the type under discussion, wherein the occurrence of current peaks during charging of the flash capacitor is reliably avoided in all circumstances, even in high-speed or very-high speed copiers.

Another object is to provide such an arrangement which achieves the desired elimination of current peaks with a relatively simple and trouble-free construction.

In pursuance of these objects, and others which will become apparent hereafter, one feature of the invention resides in an electrophotographic copier, in a combination comprising a fusing station at which a toner image is fixed on a copy carrier, including a flash tube positioned to direct heat resulting from its discharge against the toner image; a flash capacitor in circuit with the flash tube to supply the same with electrical energy; and means for charging the flash capacitor with a substantially peak-free current, comprising an electric motor and a generator driven by the motor and in circuit with the flash capacitor to charge the same.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The single FIGURE is a somewhat diagrammatic illustration of a copier fusing station embodying the invention.

DESCRIPTION OF A PREFERRED EMBODIMENT

The FIGURE omits all such details of the electrophotographic copier which are not necessary for an understanding of the invention. Such details are fully known in the art and if desired, may be found in U.S. Pat. No. 3,062,109 to C. R. Mayo et al.

The fusing station of the otherwise not illustrated copier is provided with guides 6, 7 between or along which a copy carrier 1 (e.g., a copy sheet) is advanced by the transporting rollers 2, 3. A drive for the transporting rollers is conventional and therefore requires no illustration.

The copy carrier 1 is provided with an image formed by the toner particles (not shown) which were previously transferred to the carrier 1 in the usual manner. These particles are now to be fused to the carrier 1. This is done by heat radiating from the flash tube 5 (which is provided with the illustrated reflector 4) when the flash tube is discharged. Evidently, the guides 6, 7 must be so constructed that heat from the flash tube 5 can reach the surface of carrier 1; however, this is also conventional and known per se.

The energy required for operation (flashing) of the flash tube 5 is supplied by a flash capacitor 12. The flash capacitor in turn is not charged from net current, as in the prior art. It is, instead, charged by a system which acts as a "buffer" to eliminate the occurrence of current peaks during the rapid charging of the capacitor 12.

This system utilizes an electric motor 8 which is driven by current from the current net. Motor 8 has an output shaft 9 which is coupled to the input shaft for the rotor of a generator 10; of course, the shaft 9 could itself also constitute the input shaft for the generator, i.e., be an element which is common to both the motor 8 and the generator 10. A flywheel 11 or similar inertial mass is mounted on the shaft 9 for rotation therewith. Generator 10 is advantageously a three-phase generator; a rectifier 15 must then be interposed in circuit between it and the flash capacitor 12 to supply the latter with rectified charging current. Such an arrangement is of advantage because it operates very quietly (low noise) and is subject to a minimum of wear, thus making the construction trouble-free over long periods of time. If desired it would, however, be possible to use a direct-current generator with commutator, instead.

The flash capacitor provides only the electrical energy for the flashing of the tube 5. The signal which triggers the flashing is supplied as a high-voltage pulse to the trigger electrode 13 of the flash tube 5, via a conductor 14. The timing and generation of the trigger signal form no part of the invention; both are effected by arrangements which are known per se and which already form part of copiers having fusing stations with flash tubes. In synchronism with the application of each triggering pulse via conductor 14 to electrode 13, the flow of charging current to the capacitor 12 is interrupted (the means for this are known per se) until the flash tube 5 is de-ionized. Thereafter, the current path is restored and charging of the capacitor 12 begins.

The arrangement in accordance with the invention eliminates harmful current peaks (during charging of the capacitor 12) without the phase angle control circuit proposed in the prior art. Due to the rotational energy of its rotating components (in motor 8 and generator 10) the system acts as a buffer, i.e., it is a mechanical energy-storing arrangement from whose inertial motion part of the energy required to charge the flash capacitor 12 is derived. This means that the net current used to maintain the revolution of motor 8 is no longer subject to fluctuations during charging of the capacitor 12 and, therefore, such charging can now take place very rapidly without having to fear the development of current peaks, i.e., shock-like demands upon the current supply net.

The arrangement will operate satisfactorily without the inertial mass 11. However, the presence of this mass further regularizes the demand upon the supply net because it increases the inertia of the drive system composed of motor 8 and generator 10 and thus makes the "buffer" effect (i.e., the "smoothing out" of demand upon the supply net) more pronounced.

Still further, the arrangement according to the invention has a higher internal resistance than the current supply net itself, so that the direct current which it supplies to the flash capacitor 12 is subject to only relatively small fluctuations. This means that the available capacitor-charging time can be utilized to the full without, however, engendering any sudden, shock-like demands upon the supply net due to current peaks.

While the invention has been illustrated and described as embodied in an electrophotographic copier, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of the piror art, fairly constitute essential characteristics of the generic or specific aspects of this invention.

What is claimed as new and desired to be protected by Letters Patent is set forth in the appended claims;

1. In an electrophotographic copier, a combination comprising a fusing station at which a toner image is fixed on a copy carrier, including a flash tube positioned to direct heat resulting from its discharge against the toner image; a flash capacitor in circuit with said flash tube to supply the same with electrical energy; and means for charging said flash capacitor with a substantially peak-free current, comprising an electric motor connected to a supply net and a generator driven by said motor and in circuit only with said flash capacitor to charge the same.

2. A combination as defined in claim 1, wherein said generator is a three-phase generator and said means comprise a rectifier interposed between said generator and said flash capacitor.

3. A combination as defined in claim 1; and further comprising means for increasing the inertia of the drive system constituted by said motor and said generator.

4. A combination as defined in claim 3, said increasing means comprising an inertial mass.

5. A combination as defined in claim 3, said increasing means comprising a flywheel.

6. A combination as defined in claim 3, said motor having an output shaft coupled with said generator, and said increasing means comprising a flywheel mounted on said output shaft.

* * * * *